United States Patent [19]

Sasaki et al.

[11] Patent Number: 4,532,202

[45] **Date of Patent: * Jul. 30, 1985**

[54] COUPLER FOR PHOTOGRAPHY

[75] Inventors: Takashi Sasaki; Yutaka Kaneko; Fumio Ishii; Yasuo Tsuda; Kazuhiko Kimura; Katsunori Kato, all of Hino, Japan

[73] Assignee: Konishiroku Photo Industry Co., Ltd., Tokyo, Japan

[ * ] Notice: The portion of the term of this patent subsequent to Jul. 31, 2001 has been disclaimed.

[21] Appl. No.: 564,241

[22] Filed: Dec. 21, 1983

[30] Foreign Application Priority Data

Dec. 29, 1982 [JP] Japan ..... 57-232131

[51] Int. Cl.[3] ..... G03C 7/26

[52] U.S. Cl. ..... 430/552; 430/553

[58] Field of Search ..... 430/384, 385, 505, 552, 430/553

[56] References Cited

U.S. PATENT DOCUMENTS

| | | | |
|---|---|---|---|
| 3,880,661 | 4/1975 | Lau et al. | 430/553 |
| 4,124,396 | 11/1978 | Osborn | 430/553 |
| 4,334,011 | 6/1982 | Aoki et al. | 430/552 |
| 4,455,367 | 6/1984 | Seoka et al. | 430/553 |
| 4,463,086 | 7/1984 | Sasaki et al. | 430/505 |

*Primary Examiner*—J. Travis Brown

*Attorney, Agent, or Firm*—Frishauf, Holtz, Goodman & Woodward

[57] ABSTRACT

There is disclosed a coupler for photography represented by the formula:

wherein $R_1$ represents a branched alkyl group having 3 to 5 carbon atoms; $R_2$ represents an aryl group; X represents a divalent linking group; Ar represents an aryl group; and Z is a hydrogen atom or a group eliminable through the coupling reaction with the oxidized product of an aromatic primary amine type color developing agent, and a light-sensitive silver halide photographic material comprising the same.

The coupler mentioned above is not only excellent in solubility in organic solvents, but also can be easily purified, thus being capable of exhibiting excellent characteristics with respect to spectral absorption characteristics, sensitivity, color density, color staining as well as with respect to image storability such as light resistance, heat resistance and humidity resistance.

10 Claims, No Drawings

COUPLER FOR PHOTOGRAPHY

BACKGROUND OF THE INVENTION

1. Field of the art

This invention relates to a coupler for photography, more particularly to a 2,5-diacylaminophenol type cyan coupler which is suitable for a light-sensitive silver halide color photographic material.

2. Prior art and its problems

Ordinarily, in light-sensitive silver halide color photogaphic materials, silver halide grains exposed to light are reduced with an aromatic primary amine type color developing agent, and dye images can be obtained through coupling of the oxidized product of the above-mentioned color developing agent which has been thereby formed with couplers for forming respective dyes of yellow, magenta and cyan.

The cyan couplers widely employed for formation of the aforesaid cyan dyes are phenol type and naphthol type couplers. In particular, the first point to be improved in phenol type cyan couplers to be utilized for final images is to have good spectral absorption characteristics of cyan dyes, more specifically to have weak absorption in the green region (particularly at 500 nm–550 nm) of the absorption with the maximum absorption wavelength being at longer wavelength region (640 nm–660 nm). Secondly, the cyan dye formed should have sufficient fastness to light, heat and humidity, and staining at the portion without color formation should be little under these storage conditions. Thirdly, it is also required to have good color forming property, namely sufficient color forming sensitivity and color forming density. And, fourthly, color loss should be small even when the bleaching bath or bleach-fixing bath comprising ferric EDTA salt as the main component may be fatigues after usage for a long term.

A large number of proposals have been heretofore been made to improve these points. Particularly, as the cyan couplers which are attracting attention for excellent characteristics with respect to the fourth point as mentioned above, there are 2,5-diacylaminophenol type cyan couplers. Illustrative of such cyan couplers are 2,5-diacylaminophenol type cyan couplers having a fluorine-substituted aliphatic carboxylic acid amido group at the 2-position of phenol and an acylamino group at the 5-position as disclosed in U.S. Pat. Nos. 2,772,162 and 2,895,826. These 2,5-diacylaminophenol type cyan couplers known as specific compounds are indeed excellent in heat resistance of cyan dyes formed and also excellent in spectral absorption characteristics, but they involve vital drawbacks that they are markedly inferior in color forming properties of the couplers per se and light resistance of the dyes formed. Accordingly, for improvement of these drawbacks, the so called two equivalent couplers have been proposed, in which fluorine atoms is introduced at the 4-position where the coupling reaction occurs between the color developing agent and the oxidized product, as disclosed in U.S. Pat. No. 3,758,308. These couplers, while they exhibit excellent color forming properties, have undesirable properties that yellow staining will be formed by light.

Also, U.S. Pat. Nos. 3,758,308 and 3,880,661 disclose 2,5-diacylaminophenol type cyan couplers having a pentafluorobenzamido group at the 2-position of phenol ring. On the other hand, 2,5-diacylaminophenol type cyan couplers having o-sulfonamidobenzamide group at the 2-position of phenol ring are disclosed in Japanese Provisional Patent Publication No. 80045/1981. These diacylaminophenol type cyan couplers are satisfactory with respect to spectral absorption characteristics, but not necessarily sufficient with respect to fastness of dyes.

Also, 2,5-diacylaminophenol type cyan couplers having a sulfonamido group at the 5-position of phenol ring have also been developed, as disclosed in Japanese Provisional Patent Publication Nos. 109630/1978, 163537/1980, 22235/1981, 99341/1981, 116030/1981, 55945/1981 and 80054/1981. Further, Japanese Provisional Patent Publication No. 161542/1981 discloses 2,5-diacylaminophenol type cyan couplers having a benzamido group substituted with at least one fluorine atom at the 2-position of phenol ring. Whereas, the dyes formed from these couplers are excellent in fastness but insufficient in spectral absorption characteristics.

The present inventors have made extensive studies in order to remove the above-mentioned drawbacks possessed by the 2,5-diacylaminophenol type cyan couplers of the prior art, and consequently found that a certain class of 2,5-diacylaminophenol type couplers having an arylacylamino group at the 2-position are excellent inspectral absorption characteristics and markedly improved in image storability. These couplers are already described in U.S. patent application Ser. No. 520,556. These couplers have overcome the various drawbacks as mentioned above, but they are insufficient in solubility in organic solvents when dissolved or dispersed with the use of an organic solvent such as ethyl acetate and therefore a large amount of such a solvent is required to be used. Another inconvenience was also found to be involved that cyan couplers became precipitated, if the gelatin emulsion after dispersing was not maintained at a high temperature. Accordingly, production of photographic materials on an industrial scale with the use of the cyan couplers involving such inconveniences will impair markedly productivity thereof. Now, as the method for improvement of solubility, it may be considered to introduce a straight and long chain alkyl group into the acylamino group at the 5-position. However, as the result of investigation by the present inventors about the solubility of 2,5-diacylaminophenol type cyan coupler having introduced a straight and long chain alkyl group into the acylamino group at the 5-position, it was found to be still insufficient in solubility, and said coupler was also found to be difficulty purified. Solubility of the coupler was found to be further markedly improved by introduction of a long chain and branched alkyl group in place of the straight alkyl. In this case, however, since the carboxylic acid ester usually employed for introduction of such a long chain and branched alkyl has a high boiling point, purification of such a carboxylic acid ester becomes difficult. Consequently, there was the drawback that it was difficult to obtain a coupler of the final product at high purity, when such a carboxylic acid ester is used as the intermediate.

SUMMARY OF THE INVENTION

OBJECT OF THE INVENTION

An object of this invention is to provide a coupler for photography, which is not only excellent in solubility in organic solvents, but also can be easily purified, thus being capable of exhibiting excellent characteristics with respect to spectral absorption characteristics, sensitivity, color density, color staining as well as with respect to image storability such as light resistance, heat resistance and humidity resistance.

The present inventors have found that the above object can be attained by a coupler for photography represented by the formula [I] shown below to accomplish this invention.

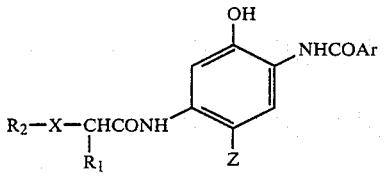

Formula [I]

wherein $R_1$ represents a branched alkyl group having 3 to 5 carbon atoms; $R_2$ represents an aryl group; X represents a divalent linking group; Ar represents an aryl group; Z represents a hydrogen atom or a group eliminable through the coupling reaction with the oxidized product of an aromatic primary amine type color developing agent.

DETAILED DESCRIPTION OF THE PREFERRED EMBODIMENTS

In this invention, the branched alkyl group having 3 to 5 carbon atoms represented by $R_1$ in the formula [I] may include isopropyl group, isobutyl group, sec-butyl group, t-butyl group, isopentyl group, neopentyl group, sec-pentyl group, t-pentyl group and the like.

The aryl group represented by $R_2$ in the formula [I] may be, for example, a phenyl group, a naphthyl group and the like, preferably a phenyl group. When this phenyl group has substituent(s), these substituents may include, for example, halogen atoms (preferably chlorine or bromine); alkyl groups {preferably straight or branched alkyl groups having 1 to 20 carbon atoms (e.g. methyl, t-butyl, t-pentyl, t-octyl, dodecyl, pentadecyl)}; aralkyl groups (e.g. benzyl, phenetyl); aryl groups (e.g. phenyl); heterocyclic groups (preferably nitrogen containing heterocyclic groups); alkoxy groups {preferably straight or branched alkyloxy groups having 1 to 20 carbon atoms (e.g., methoxy, ethoxy, t-butyloxy, octyloxy, decyloxy, dodecyloxy)}; aryloxy groups (e.g. phenoxy); hydroxyl group; acyloxy groups (preferably alkylcarbonyloxy groups (e.g. acetoxy) or arylcarbonyloxy groups (e.g. benzoyloxy)}; hydroxycarbonyl group; alkoxycarbonyl groups (preferably straight or branched alkyloxycarbonyl groups having 1 to 20 carbon atoms); aryloxycarbonyl groups (preferably phenoxycarbonyl groups); mercapto group; alkylthio groups {preferably straight or branched alkylthio groups (e.g. methylthio, octylthio, dodecylthio)}; acyl groups (preferably straight or branched alkylcarbonyl groups); acylamino groups (preferably straight or branched alkylcarboamido groups having 1 to 20 carbon atoms or benzamido groups); sulfonamido groups (preferably straight or branched alkylsulfonamido groups having 1 to 20 carbon atoms or benzenesulfonamido group); carbamoyl groups (preferably alkylaminocarbonyl groups having 1 to 20 carbon atoms or phenylaminocarbonyl group); sulfamoyl groups (preferably straight or branched alkylaminosulfonyl groups having 1 to 20 carbon atoms or phenylaminosulfonyl group); and so on. One to 5 of these substituents may be introduced into the phenyl group. Among them, preferably substituents are alkyl groups, sulfonamide groups and sulfamoyl groups, and $R_2$ may preferably a phenyl group having at least one of these alkyl groups, sulfonamide groups and sulfamoyl groups as substituent.

The divalent linking group represented by X in the formula [I] may be, for example, —O—, —S—, ⟮alkylene⟯O, ⟮alkylene⟯S— (alkylene being, for example, methylene, ethylene or the like). X may preferably be —O—.

The aryl group represented by Ar in the formula [I] may be, for example, a phenyl group, a naphthyl group and the like, preferably a phenyl group. When this phenyl group has substituent(s), these substituents may include, for example, halogen atoms (preferably chlorine or fluorine); alkyl groups {preferably straight or branched alkyl groups having 1 to 20 carbon atoms (e.g. methyl, t-butyl, t-pentyl, t-octyl, dodecyl, pentadecyl}; aralkyl groups (e.g. benzyl, phenetyl); aryl groups (e.g. phenyl); heterocyclic groups (preferably nitrogen containing heterocyclic groups); alkoxy groups {preferably straight or branched alkyloxy groups having 1 to 20 carbon atoms (e.g. methoxy, ethoxy, t-butyloxy, octyloxy, decyloxy, dodecyloxy)}; aryloxy groups (e.g. phenoxy); hydroxyl group; acyloxy groups {preferably alkylcarbonyloxy groups (e.g. acetoxy) or arylcarbonyloxy groups (e.g. benzoyloxy)}; hydroxycarbonyl group; alkoxycarbonyl groups (preferably straight or branched alkyloxycarbonyl groups having 1 to 20 carbon atoms); aryloxycarbonyl groups (preferably phenoxycarbonyl groups); mercapto group; alkylthio groups {preferably straight or branched alkylthio groups (e.g. methylthio, octylthio, dodecylthio)}; acyl groups (preferably straight or branched alkylcarbonyl groups); acylamino groups (preferably straight or branched alkylcarboamido groups or benzamido groups); sulfonamido groups (preferably straight or branched alkylsulfonamido groups having 1 to 20 carbon atoms or benzenesulfonamido group); carbamoyl groups (preferably alkylaminocarbonyl groups having 1 to 20 carbon atoms or phenylaminocarbonyl group); sulfamoyl groups (preferably straight or branched alkylaminosulfonyl groups having 1 to 20 carbon atoms or phenylaminosulfonyl group); and so on. One to 5 of these substituents may be introduced into the phenyl group. Among them, preferable substituents are halogen atoms and sulfonamido groups, and Ar may preferably be a phenyl group having at least one of these halogen atoms and sulfonamido groups as substituent, particularly preferbly pentafluorophenyl group.

The group eliminable through the coupling reaction with the oxidized product of an aromatic primary amine type color developing agent represented by Z in the formula [I] may be, for example, a halogen atom (e.g. chlorine, bromine, fluorine), or an aryloxy group, a carbamoyloxy group, a carbamoylmethoxy group, an acyloxy group, a sulfonamido group, or a succinimido group, of which the oxygen atom or the nitrogen atom is directly bonded to the coupling site. Further, specific examples of these groups are disclosed in U.S. Pat. No. 3,476,563; Japanese Provisional Patent Publication No. 37425/1972; Japanese Patent Publication No. 36894/1973; Japanese Provisional Patent Publication Nos. 10135/1975, 117422/1975, 130441/1975, 108841/1976, 120334/1975, 18315/1977, 52423/1978 and 105226/1978. Z may preferably be a halogen atom, particularly preferably a chlorine atom.

Specific examples of the compounds of this invention are enumerated below, but this invention is not limited thereto.

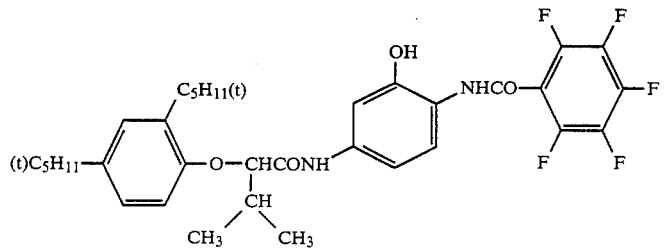
(I-1)
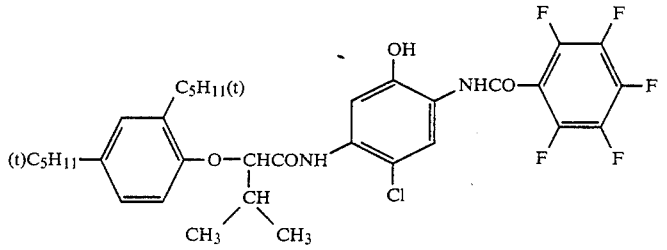
(I-2)
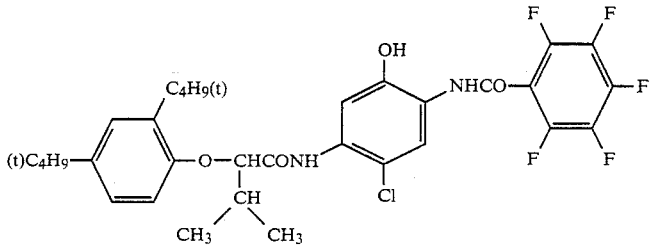
(I-3)
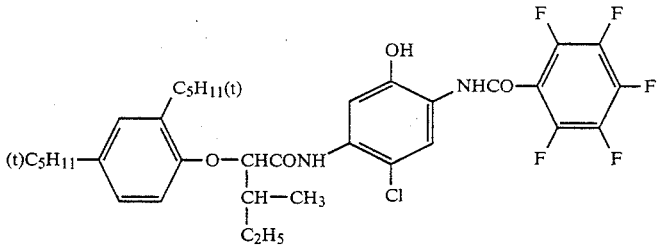
(I-4)
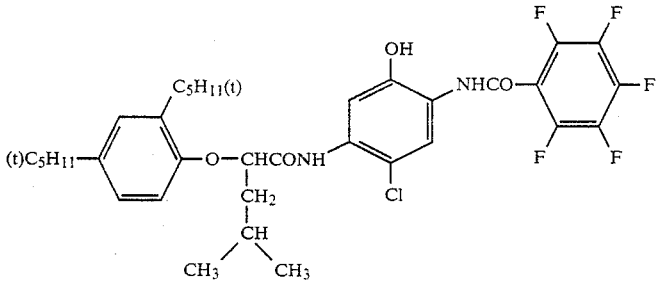
(I-5)
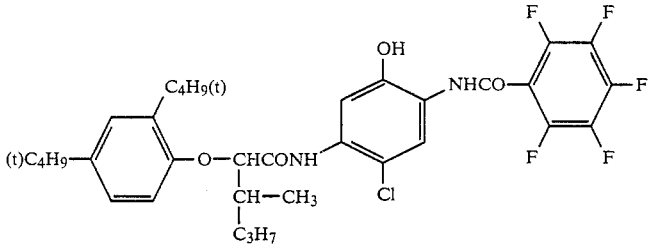
(I-6)

-continued
(I-7)
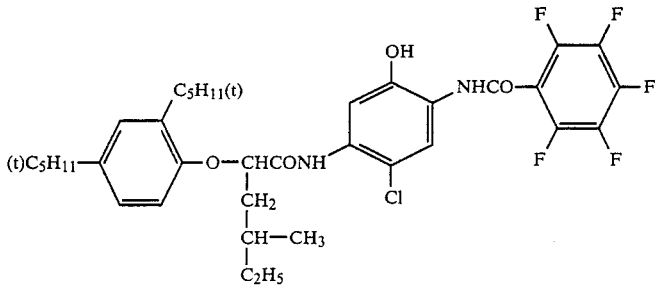
(I-8)
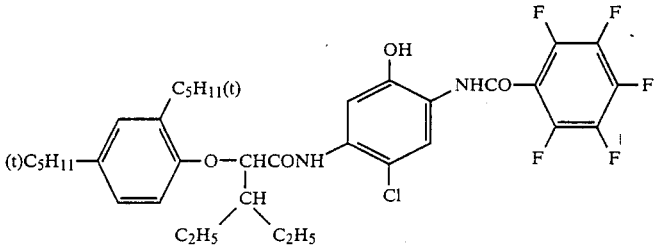
(I-9)
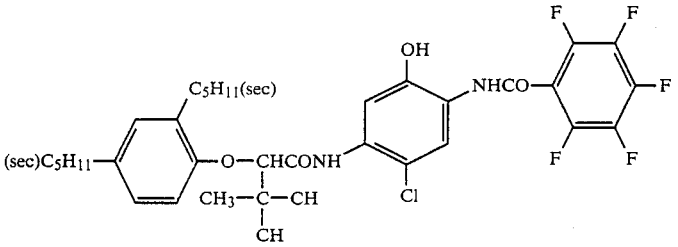
(I-10)
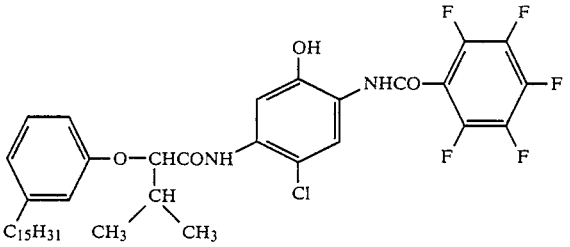
(I-11)
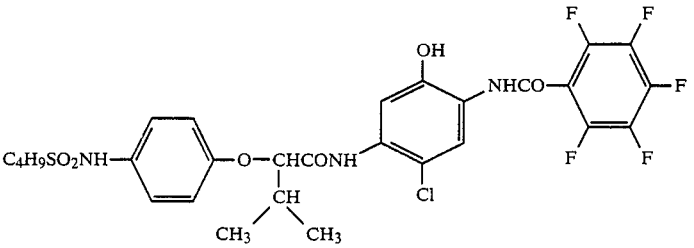
(I-12)
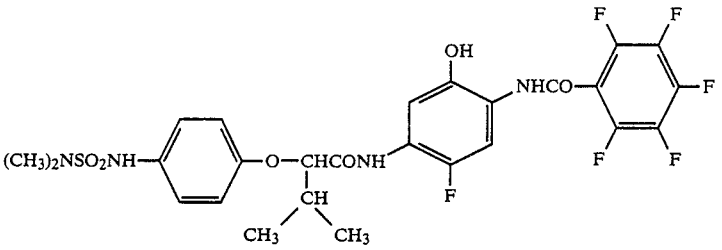

-continued
(I-13)
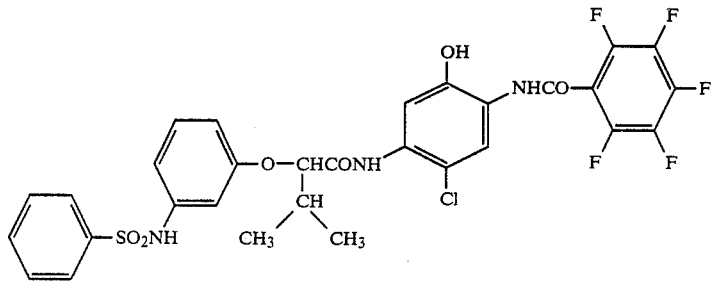
(I-14)
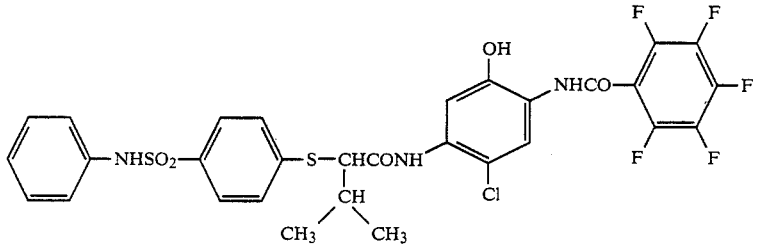
(I-15)
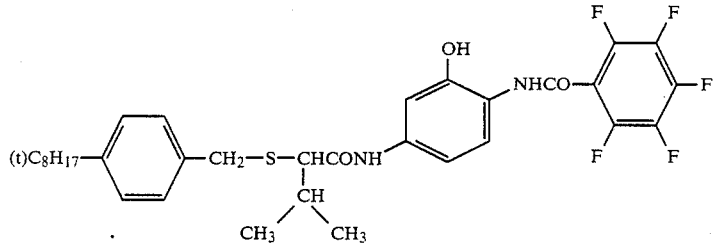
(I-16)
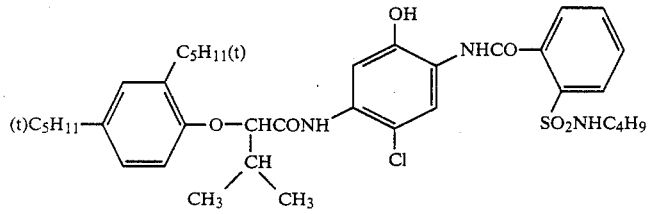
(I-18)
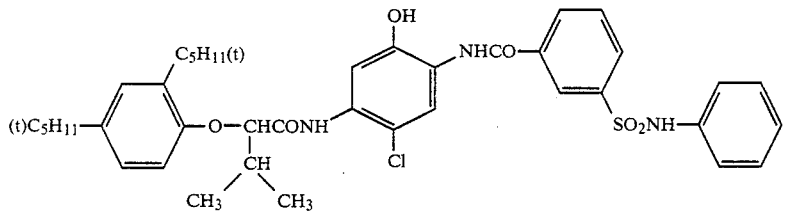
(I-19)
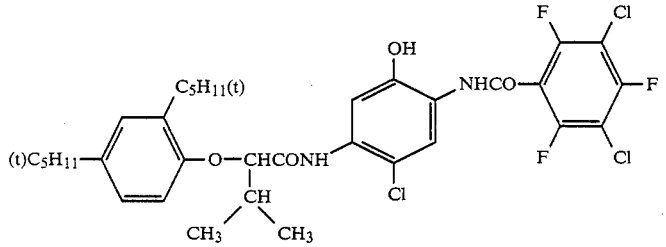

-continued

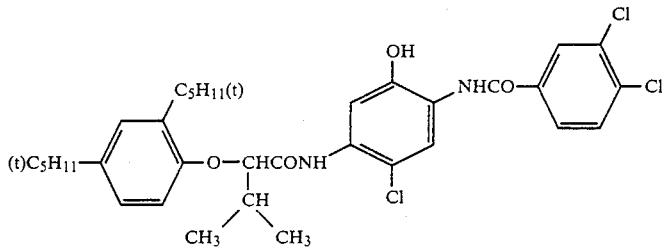

(I-20)

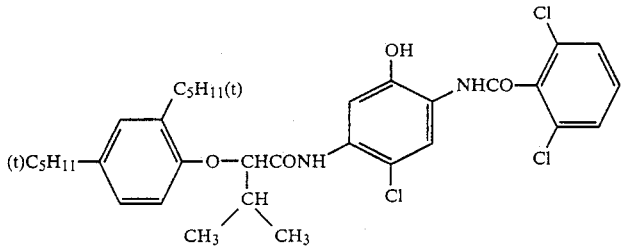

(I-21)

The compounds represented by the formula [I] can easily be synthesized according to, for example, the reaction schemes as shown below, as described in detail by way of Synthesis examples set forth below.

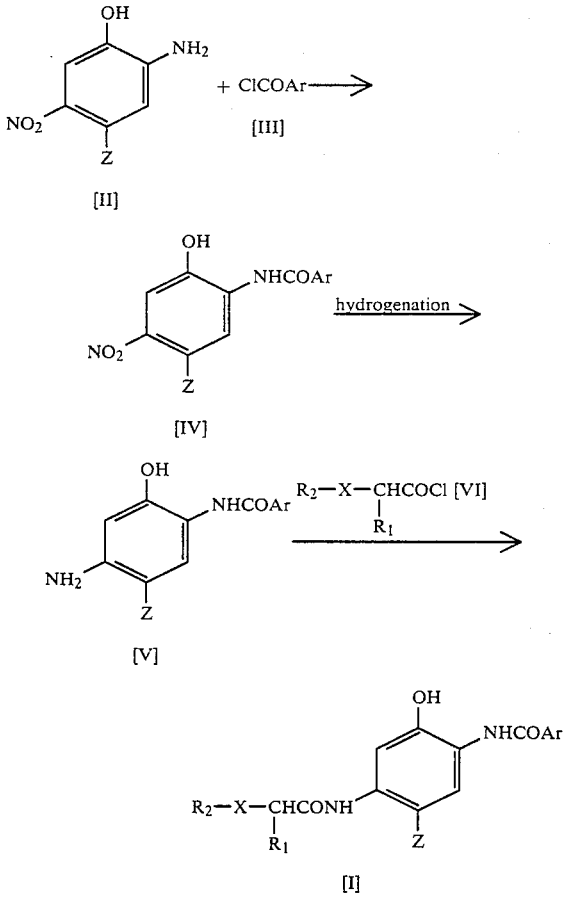

wherein Z, Ar, $R_1$, $R_2$ and X have the meanings as described above.

The above-mentioned intermediate compound [VI] can be synthesized according to, for example, the reaction schemes shown below.

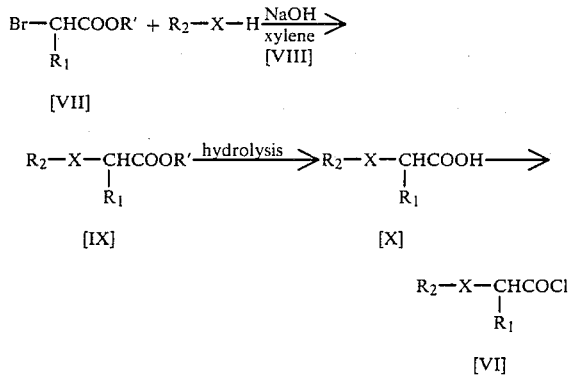

wherein R' represents an alkyl group; $R_1$ and $R_2$ and X have the meanings as described above.

Synthesis example 1: Synthesis of intermediate [VI]

Intermediate compounds [VI] having isopropyl group (this invention), 1-methyl-3,3-dimethylbutyl group (Control), n-butyl group (Control), n-hexyl group (Control) or n-octyl group (Control) as $R_1$ and 2,4-di-t-amylphenoxy group as $R_2$—X group were synthesized. That is, first, α-bromocarboxylic acid ester [VII] and 2,4-di-t-aminophenol were refluxed in xylene with the use of caustic soda as alkali to obtain an intermediate α-2,4-di-t-amylphenoxy carboxylic acid ester [IX]. The purified products obtained by purification by distillation under reduced pressure of these intermediates [IX] had the boiling points and purities as shown in Table 1. Then, these purified products of intermediates [IX] were hydrolyzed to give carboxylic acids [X], which were further converted to carboxylic acid chlorides to obtain intermediate compounds [VI].

TABLE 1

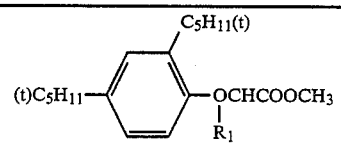

| $R_1$: | $-CH(CH_3)_2$ | $-CH(CH_3)-CH_2-C(CH_3)_2$ | $-C_4H_9(n)$ | $-C_6H_{13}(n)$ | $-C_8H_{17}(n)$ |
|---|---|---|---|---|---|
| Boiling point: (°C/2.5 mmHg) | 143–150 | 185–195 | 158–182 | 170–175 | 195–205 |
| Purity: | >99% This invention | 95% Control | 75% Control | 80% Control | 90% Control |

Purity was measured according to FID-gas chromatography (column PEG-20M).

As apparently seen from the Table, the carboxylic acid ester [IX], which is the intermediate compound of the coupler for photography of this invention, has a low boiling point and high purity.

Synthesis example 2: Synthesis of 2-(2,3,4,5,6-pentafluoro)benazmido-4-chloro-5-[α-(2,4-di-t-amylphenoxy)-β-methylbutaneamido]phenol [Exemplary compound (I-2)]

4 Grams of 2-(2,3,4,5,6-pentafluoro)benzamido-4-chloro-5-aminophenol [V] and 4.9 g of α-(2,4-di-t-amylphenoxy)-β-methylbutanoyl chloride [VI] were added into 100 cc of acetonitrile and refluxed under heating for 8 hours. The reaction mixture was filtered while hot to remove insolubles, and the solution was left to stand at room temperature. The crystals precipitated were collected by filtration and dried. Then, the crystals were recrystallized again from acetonitrile to give 4.2 g of the title compound (I-2) as white crystals, melting at 192°–193° C. Yield: 90% (calculated from [V]).
The structure was determined from NMR and mass spectrum.

Synthesis example 3: Synthesis of 2-(2,3,4,5,6-pentafluoro)benzamido-4-chloro-5-[α-(m-pentadecylphenoxy)-β-methylbutaneamido]phenol [Exemplary compound (I-10)]

4.0 Grams of 2-(2,3,4,5,6-pentafluoro)benzamido-4-chloro-5-aminophenol [V] and 5.6 g of α-(m-pentadecylphenoxy)-β-methylbutanoyl chloride [VI] were added into 100 cc of acetonitrile and refluxed under heating for 8 hours. Acetonitrile was evaporated under reduced pressure, and water was added to the residue. The oily product formed was extracted with ethyl acetate. The oil layer was separated, dried and ethyl acetate was evaporated under reduced pressure. The residue was further recrystallized from acetonitrile to give the title compound (I-10) as white crystals, melting at 190°–193° C. Yield: 92%. The structure was determined from NMR and mass spectrum.

Synthesis example 4: Synthesis of 2-(2,3,4,5,6-pentafluoro)benzamido-4-chloro-5-[α-(2,4-di-t-amylphenoxy)-β-ethylpentaneamido]phenol [Exemplary compound (I-8)]

After high purity α-(2,4-di-t-amylphenoxy)-β-ethylpentanoyl chloride [VI] was prepared according to the same method as in Synthesis example 1, following the same procedure as in Synthesis example 2 by use of this intermediate [VI], white crystals of the title compound (I-8) were obtained. Yield: 85% (calculated from [V]). The structure was determined from NMR and mass spectrum.

Synthesis example 5: Synthesis of 2-(2,3,4,5,6-pentafluoro)benzamido-4-chloro-5-[α-(2,4-di-sec-amylphenoxy)-β,β-dimethyl-butaneamido]-phenol [Exemplary compound (I-9)]

After high purity α-(2,4-di-sec-amylphenoxy)-β,β-dimethyl butanoyl chloride [VI] was prepared according to the same method as in Synthesis example 1, following the same procedure as in Synthesis example 2 by use of this intermediate [VI], white crystals of the title compound (I-9) were obtained. Yield: 85% (calculated from [V]). The structure was determined from NMR and mass spectrum.

Synthesis example 6: Synthesis of 2-(2,3,4,5,6-pentafluoro)benzamido-4-chloro-5-[α-3-phenylsulfonylamylphenoxy)-β-methyl-butaneamido]-phenol [Exemplary compound (I-13)]

After high purity α-(3-phenylsulfonylaminophenoxy)-β-methylbutanoyl chloride [VI] are prepared according to the same method as in Synthesis example 1, following the same procedure as in Synthesis example 2 by use of this intermediate [VI], white crystals of the title compound (I-13) were obtained. Yield: 88% (calculated from [V]). The structure was determined from NMR and mass spectrum.

USE OF THE INVENTION

The coupler for photography of this invention is generally used as a cyan dye forming coupler, and in this case the methods and techniques employed in ordinary cyan dye forming couplers may be similarly applied. Typically, the coupler for photography of this invention is formulated into a silver halide emulsion, and the resultant emulsion is applied on a support to form a light-sensitive silver halide photographic material (the thus formed light-sensitive silver halide photographic material is hereinafter referred to as the light-sensitive silver halide photographic material according to this invention).

The light-sensitive silver halide photographic material according to this invention can be a light-sensitive silver halide photographic material for either monochromatic or multi-color use. In a light-sensitive silver halide photographic materials for multi-color, the coupler of the present invention is usually contained in a red sensitive silver halide emulsion layer, but it may also be contained in an emulsion layer having light sensitivity in the three primary color regions of the spectrum other than red sensitivity. Each of these emulsion layers may consist of any of a single emulsion layer or multiple emulsion layers having a sensitivity in a predetermined region. Also, each constituent layer of the light-sensitive silver halide photographic material for multi-color, including these emulsion layers, can be arranged in various orders, as is well known in the art. A typical light-sensitive silver halide for multi-color comprises at least one red-sensitive silver halide emulsion layer containing at least one cyan dye forming coupler (at least one of cyan dye forming couplers is the coupler for photography of this invention), at least one green-sensitive silver halide emulsion layer containing at least one magenta dye forming coupler and at least one blue-sensitive silver halide emulsion layer containing at least one yellow dye forming coupler carried on a support. The light-sensitive silver halide photographic material can also have, other than these, a filter layer, an intermediate layer, a protective layer, a subbing layer, etc.

The coupler for photography of this invention can be incorporated in an emulsion according to the methods known in the art. For example, a silver halide emulsion can be prepared by dissolving the coupler for photography of this invention either singly or in combination in a high boiling organic solvent having a boiling point of 175° C. or higher such as tricresyl phosphate, dibutyl phthalate, etc. or a low boiling organic solvent such as butyl acetate, butyl propionate, etc. or, if necessary, in a mixture of these solvents, then mixing the resultant solution in an aqueous gelatin solution containing a surfactant, subsequently emulsifying the mixture in a high speed rotatory mixer or a colloid mill and adding the emulsion to silver halide. When adding the coupler for photography of this invention to a silver halide emulsion, it is added in an amount generally of 0.07 to 0.7 mole, preferably 0.1 to 0.4 mole per mole of silver halide.

The silver halide to be used in the silver halide emulsion employed in the present invention may include any of those used in ordinary silver halide emulsions such as silver bromide, silver chloride, silver iodobromide, silver chlorobromide, silver chloroiodobromide and the like.

The silver halide emulsion constituting the silver halide emulsion used in this invention can be prepared according to all of the preparation mehods, including those conventionally practiced and various preparation methods, such as the method as disclosed in Japanese Patent Publication No. 7772/1971 or the method as disclosed in U.S. Pat. No. 2,592,250, namely the preparation method of the so called conversion emulsion, wherein an emulsion of silver salt grains comprising at least a part of silver salts having greater solubility than silver bromide and then at least a part of the grains is converted to silver bromide or silver iodobromide, or the preparation method of Lipman emulsion comprising fine grains of silver halide having a mean grain size of $0.1\mu$ or less.

Further, the silver halide emulsion used in this invention can be chemically sensitized with a sulfur sensitizer, such as allylthiocarbamide, thiourea, cystine and others; an active or inactive selenium sensitizer; and a reducing sensitizer such as stannous salts, polyamines, etc.; a noble metal sensitizer, for example, gold sensitizers, more specifically potassium aurithiocyanate, potassum chloroaurate, 2-aurosulfobenzthiazole methylchloride, or a sensitizer of water-soluble salt of ruthenium, rhodium, iridium and others, more specifically ammonium chloropalladate, potassium chloroplatinate and sodium chloropalladite. These sensitizers may be used either singly or in a suitable combination.

The silver halide emulsion to be used in this invention may also incorporate various kinds of additives for photography known in the art. For example, there may be employed additives for photography as disclosed in Research Disclosure, Item 17643, December 1978.

In the light-sensitive silver halide photographic material, the hydrophilic colloid to be used for preparation of emulsion may be inclusive of any of gelatin, gelatin derivatives, graft polymers of gelatin with other polymers, proteins such as albumin, casein and the like cellulose derivatives such as hydroxyethylcellulose derivatives, carboxymethylcellulose, etc., starch derivatives, synthetic hydrophilic homopolymers or copolymers of poly(vinyl alcohol), poly(vinylimidazole), polyacrylamide, etc.

The light-sensitive silver halide photographic material is prepared by coating of the emulsion layer, optionally containing various additives for photography as mentioned above, together with other constituent layers by way of coating directly on a support applied with corona discharging treatment, flame treatment or UV-ray irradiation treatment or through a subbing layer or intermediate layer interposed therebetween. As the support which can advantageously be used, there are, for example, baryta paper, polyethylene coated paper, polypropylene synthetic paper, transparent support having provided a reflection layer in combination or using a reflection plate in combination, such as glass plate, cellulose acetate, cellulose nitrate or polyester film (e.g. polyethyleneterephthalate), polyamide film, polycarbonate film, polystyrene film and others. These supports may be selected suitably depending on the respective purposes of use of the light-sensitive silver halide photographic material.

For coating of the emulsion layer and other constituent layers, there may be employed various coating methods such as dipping coating, air doctor coating, curtain coating, hopper coating and others. It is also possible to employ the simultaneous coating of two or more layers as disclosed in U.S. Pat. Nos. 2,761,791 and 2,941,898.

In the light-sensitive silver halide photographic material according to this invention, an intermediate layer with a suitable thickness may be provided as desired depending on the purpose, and further it is possible to use various layers such as filter layer, curl prevention layer, protective layer and anti-halation layer as constituent layers in a suitable combination. In these constituent layers, the hydrophilic colloid which can be used in the emulsion as described above can also similarly be employed, and various additives for photography which can be contained in the emulsion as described above can also be contained in these layers.

The light-sensitive silver halide photographic material can be utilized for various uses and can exhibit excellent characteristics depending on the respective purposes, such as posi-type light-sensitive material, direct posi-type light-sensitive material or light-sensitive material for special purpose (e.g. for printing, X-ray or high resolving power). In particular, it is suitable for color photographic paper.

The silver halide to be used in the present invention, in order to impart sensitivity to the light-sensitive wavelength region necessary for red-sensitive emulsion, is subjected to spectral sensitization by choice of an appropriate sensitizing dye. Various kinds of dyes may be available for the spectral sensitization dye, and either one kind or a combination of two or more kinds may be used. The spectral sensitization dyes to be used advantageously in this invention may include, for example, cyanine dyes, merocyanine dyes or complex cyanine dyes disclosed in, for example, U.S. Pat. Nos. 2,269,234; 2,270,378; 2,442,710; 2,454,620; and 2,776,280 as representative ones.

The color forming developer which can be used in this invention may preferably comprise an aromatic primary amine type color developing agent as the principal ingredient. Typical examples of such a color developing agent are those of p-phenylenediamine type, including diethyl-p-phenylenedimaine hydrochloride, monomethyl-p-phenylenediamine hydrochloride, dimethyl-p-phenylene-diamine hydrochloride, 2-amino-5-diethylaminotoluene hydrochloride, 2-amino-5-(N-ethyl-N-dodecylamino)toluene, 2-amino-5-(N-ethyl-N-β-methanesulfonamidoethyl)aminotoluene sulfate, 4-(N-ethyl-N-β-methanesulfonamidoethylamino)aniline, 4-(N-ethyl-N-β-hydroxyethylamino)aniline, 2-amino-5-(N-ethyl-N-β-methoxyethyl)aminotoluene and the like.

These color developing ingredients may be used either singly or in combination of two or more kinds. Further, if desired, they can be combined with a monochromatic (black-and-white) developing agent such as hydroquinone, phenidone and others.

The color forming developer containing the above color developing agent generally contains an alkali agent such as sodium hydroxide, ammonium hydroxide, sodium carbonate, sodium sulfite and the like, and moreover may also contain various additives such as alkali metal halide (e.g. potassium bromide), development controller (e.g. citrazinic acid) or sodium sulfate.

EFFECT OF THE INVENTION

The coupler for photography of this invention has excellent solubility in organic solvents conventionally used for dispersing a coupler, and not only the coupler dispersion obtained has the excellent characteristic that precipitation will not easily occur when stored as such or even when incorporated in a silver halide emulsion layer, but also it can very easily be purified to give a product of very high purity. Therefore, in the lightsensitive silver halide photographic material using the coupler for photography of this invention, excellent characteristics can be exhibited with respect to spectral absorption characteristics of the cyan dye formed, sensitivity, color density, color contamination, and also image storability such as light resistance, heat resistance and humidity resistance.

Thus, the coupler for photography of this invention may be stated to be a coupler for photography which can exhibit excellent characteristics in aspect of production and in aspect of utilization of the photographic elements, typically light-sensitive silver halide color photographic materials.

EXAMPLES OF THE INVENTION

This invention is described in detail below by referring to the following Examples, by which this invention is not limited.

EXAMPLE 1

Solubility tests were conducted by use of the couplers for photography of this invention and Control couplers as indicated in Table 2 below. Each one gram of respective couplers was added to a mixture of 1 ml of di-n-butyl phthalate and 4 ml of ethyl acetate and the resulting mixture was heated at 70° C. for complete dissolution, followed by sealing with a stopper. Each sample was left to stand at 20° C. and precipitation of crystals was evaluated by visual observation. The results of evaluation after one hour, 6 hours and 12 hours are shown in Table 2. In Table 2, in the evaluation column, A represents no precipitation, B slight precipitation and C precipitation in large amount.

TABLE 2

| Sample No. | Coupler | Evaluation of solubility: After one hour | After 6 hours | After 12 hours |
|---|---|---|---|---|
| 1 | Exemplary compound (I-2) | A | A | A |
| 2 | Exemplary compound (I-3) | A | A | A |
| 3 | Exemplary compound (I-4) | A | A | A |
| 4 | Exemplary compound (I-17) | A | A | A |
| 5 | Control coupler (A) | C | C | C |
| 6 | Control coupler (B) | B | C | C |
| 7 | Control coupler (C) | B | C | C |
| 8 | Control coupler (D) | B | B | C |

Control coupler (A):

Compound disclosed in U.S. patent application Ser. No. 520,556

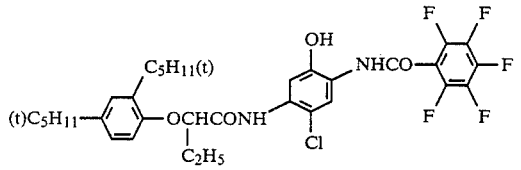

Control coupler (B):

Compound disclosed in U.S. patent application Ser. No. 520,556

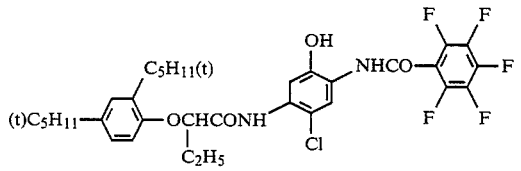

Control coupler (C):

Compound disclosed in U.S. Pat. No. 3,758,308

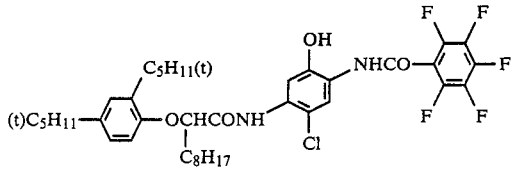

Control coupler (D):

Prepared in the same manner as in Control coupler (C) disclosed in U.S. Pat. No. 3,758,308

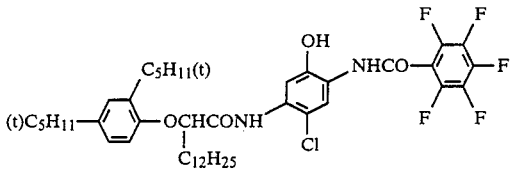

From the results in Table 2, it can be seen that the coupler for photography of this invention is not changed at all in the dissolved state when left to stand at 20° C. for 12 hours to give a stable dispersion, thus capable of providing light-sensitive silver halide photographic material which is markedly good in productivity.

EXAMPLE 2

By use of the couplers of this invention and Control couplers as indicated in Table 3, each 10 g of respective couplers was added to a mixture of 5 ml of di-n-butyl phthalate and 30 ml of ethyl acetate and completely dissolved therein by heating to 60° C. The resultant solution was mixed with 5 ml of an aqueous 10% solution of Alkanol B (aklylnaphthalene sulfonate, produced by Du Pont de Nemours & Co.) and 200 ml of an aqueous 5% gelatin solution and emulsified by means of a colloid mill to prepare respective coupler dispersions. Then, each of these coupler dispersions was added to 500 g of a gelatin-silver chlorobromide emulsion, and the mixture was applied on polyethylene coated paper, followed by drying, to prepare six kinds of light-sensitive silver halide color photographic materials. These samples were subjected to wedge exposure following the conventional procedure and then processed as follows.

| Processing step (30° C.) | Processing time |
|---|---|
| Color developing | 3 min. 30 sec. |
| Bleach-fixing | 1 min. 30 sec. |
| Washing with water | 2 min. |

In the following, compositions of respective processing solutions are shown.

[Composition of color developing solution]

| | |
|---|---|
| 4-Amino-3-methyl-N—ethyl-N—(β-methanesulfonamidoethyl)-aniline sulfate | 5.0 g |
| Benzyl alcohol | 15.0 ml |
| Sodium hexamethaphosphate | 2.5 g |
| Anhydrous sodium sulfite | 1.85 g |
| Sodium bromide | 1.4 g |
| Potassium bromide | 0.5 g |
| Borax | 39.1 g |

Made up to one liter with addition of water, and adjusted to pH 10.30 with sodium hydroxide.

[Composition of bleach-fixing solution]

| | |
|---|---|
| Iron ammonium salt of ethylenediaminetetraacetic acid | 61.0 g |
| Diammonium salt of ethylenediaminetetraacetic acid | 5.0 g |
| Ammonium thiosulfate | 124.5 g |
| Sodium metabisulfite | 13.3 g |
| Anhydrous sodium sulfite | 2.7 g |

Made up to one liter with addition of water.

For samples obtained by the above processing, photographic characteristics were measured respectively. Measurements were conducted by use of PDA-60 Model sensitometer (produced by Konishiroku Photo Industry Co.) The results are shown in Table 3 below.

The sensitivity values are shown as relative sensitivities to the value of the sample having the highest sensitivity as 100.

TABLE 3

| Sample No. | Coupler | Sensitivity | Maximum density | Maximum absorption (nm) |
|---|---|---|---|---|
| 9 | Exemplary compound (I-2) | 100 | 2.44 | 655 |
| 10 | Exemplary compound (I-10) | 97 | 2.31 | 654 |
| 11 | Exemplary compound (I-11) | 97 | 2.40 | 657 |
| 12 | Control coupler (E) | 97 | 2.16 | 654 |
| 13 | Control coupler (F) | 84 | 1.81 | 641 |
| 14 | Control coupler (G) | 40 | 1.70 | 640 |

(Control couplers)

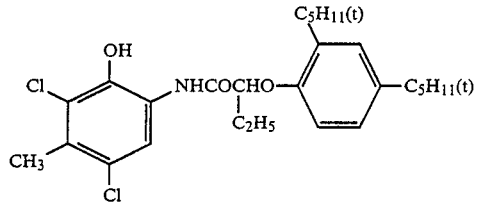

(E)

(disclosed in U.S. Pat. No. 2,801,171)

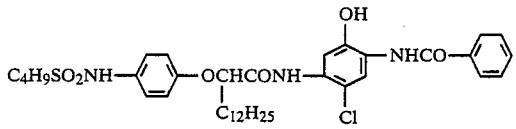

(F)

(disclosed in Japanese Provisional Patent Publication No. 109630/1978)

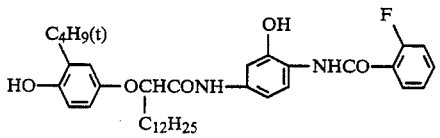

(G)

(disclosed in U.S. Pat. No. 3,880,661)

As apparently seen also from the above Table, while there are problems, particularly in sensitivity, maximum density and spectral absorption characteristics in Samples 13 and 14 employing Control couplers, the Samples employing the couplers of this invention are all excellent in sensitivity, maximum density and spectral absorption chracteristics. Thus, the coupler of this invention was found to be a coupler having good color forming property.

EXAMPLE 3

By use of the couplers of this invention and Control couplers as indicated in Table 4 below, Samples having cyan dye images were prepared in entirely the same manner as in Example 2. These Samples were tested and investigated for light resistance, heat resistance and humidity resistance of the dyes and generation of stain. The results obtained are shown in Table 4 below.

In the Table, light resistance is represented in terms of remaining density percentage relative to the initial density of 1.0 after exposure of respective images in a xenon fadometer for 200 hours, heat resistance by that after storage at 77° C. for 2 weeks, and humidity resistance by that after storage under relative humidity of 80% for 2 weeks. On the other hand, stain was represented by the degree of increase in blue density at the unexposed portion of the sample subjected to light resistance test in terms of percentage.

TABLE 4

| Sample No. | Coupler | Light resistance | Heat resistance | Humidity resistance | Stain |
|---|---|---|---|---|---|
| 15 | Exemplary compound (I-2) | 86 | 92 | 96 | 220 |
| 16 | Exemplary compound (I-3) | 81 | 93 | 97 | 240 |
| 17 | Exemplary compound (I-4) | 88 | 92 | 96 | 220 |
| 18 | Exemplary compound (I-10) | 89 | 95 | 95 | 230 |
| 19 | Exemplary compound (I-11) | 91 | 96 | 96 | 240 |
| 20 | Control coupler (E) | 75 | 42 | 56 | 220 |
| 21 | Control coupler (F) | 63 | 81 | 82 | 380 |
| 22 | Control coupler (G) | 25 | 82 | 80 | 390 |
| 23 | Control coupler (H) | 21 | 83 | 86 | 280 |
| 24 | Control coupler (I) | 86 | 83 | 84 | 520 |

(Control couplers)

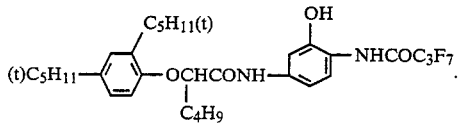

(H)

(disclosed in U.S. Pat. No. 2,895,826)

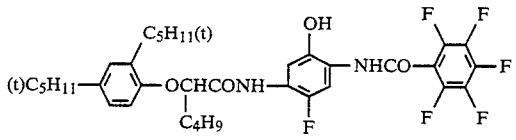

(I)

(disclosed in U.S. Pat. No. 3,758,308)

As apparently seen also from the above Table, the Control coupler (E) which was good in color forming property in the above Table 3 was markedly inferior in heat resistance and humidity resistance, while Control couplers (G) and (H) involve the problem in light resistance. Further, the Control coupler (I) is great in generation of stain. Thus, all of the Control couplers were found to have room to be improved. In contrast, the couplers of this invention were found to be not only excellent in sensitivity and image quality as shown in Table 2, but also excellent in physical characteristics, namely storability and stability of images.

We claim:

1. A light-sensitive silver halide photographic material comprising a support and, coated thereon, a silver halide emulsion layer which comprises a coupler for photography represented by the formula:

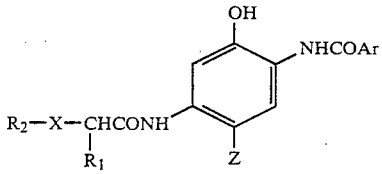

wherein $R_1$ represents a branched alkyl group having 3 to 5 carbon atoms; $R_2$ represents an aryl group; X represents a divalent linking group; Ar represents an aryl group; and Z is a hydrogen atom or a group eliminable through the coupling reaction with the oxidized product of an aromatic primary amine type color developing agent.

2. The photographic material of claim 1, wherein in said coupler, the branched alkyl group represented by $R_1$ is selected from the group consisting of an isopropyl group, an isobutyl group, a sec-butyl group, a t-butyl group, an isopentyl group, a neopentyl group, a sec-pentyl group and a t-pentyl group.

3. The photographic material of claim 1, wherein in said coupler, the aryl group represented by $R_2$ or Ar is selected from the group consisting of a phenyl group and a naphthyl group.

4. The photographic material of claim 3, wherein in said coupler, the aryl group represented by $R^2$ is a phenyl group being unsubstituted or substituted by at least one of a straight or branched alkyl group, a sulfonamido group and a sulfamoyl group.

5. The photographic material of claim 1, wherein in said coupler, the divalent linking group represented by X is selected from the group consisting of —O—, —S—, —(alkylene)—O—, and —(alkylene)—S—.

6. The photographic material of claim 5, wherein in said coupler, the divalent linking group represented by X is —O—.

7. The photographic material of claim 3, wherein in said coupler, the aryl group represented by $R_2$ is a phenyl group having at least one of a halogen atom and a sulfonamido group as substituents.

8. The photographic material of claim 7, wherein in said coupler, the aryl group represented by Ar is a pentafluorophenyl group.

9. The photographic material of claim 1, wherein in said coupler, the group eliminable through the coupling reaction with the oxidized product of an aromatic primary amine type color developing agent represented by Z is selected from the group consisting of a halogen atom, and an aryloxy group, a carbamoyloxy group, a carbamoylmethoxy group, an acyloxy group and a sulfonamido group of which the oxygen atom or the nitrogen atom is directly bonded to the coupling site.

10. The photographic material of claim 1, wherein in said coupler, the group represented by Z is a halogen atom.

* * * * *